US007712209B2

(12) United States Patent
Bouman et al.

(10) Patent No.: US 7,712,209 B2
(45) Date of Patent: May 11, 2010

(54) MAGNETIC RIVET RETENTION SYSTEM FOR A RIVET GUN

(75) Inventors: Wim Bouman, Toronto (CA); Ed Hovestadt, Ontario (CA)

(73) Assignee: Acument Intellectual Properties, LLC, Troy, MI (US)

( * ) Notice: Subject to any disclaimer, the term of this patent is extended or adjusted under 35 U.S.C. 154(b) by 1239 days.

(21) Appl. No.: 11/254,040

(22) Filed: Oct. 19, 2005

(65) Prior Publication Data

US 2006/0179649 A1 Aug. 17, 2006

Related U.S. Application Data

(60) Provisional application No. 60/652,593, filed on Feb. 14, 2005.

(51) Int. Cl.
*B23P 19/00* (2006.01)
*B25C 5/02* (2006.01)

(52) U.S. Cl. ..... 29/798; 227/113

(58) Field of Classification Search ..... 29/798, 29/810, 719, 811.2, 270, 243.53; 227/107, 227/112, 113, 119, 149
See application file for complete search history.

(56) References Cited

U.S. PATENT DOCUMENTS 5,779,127 A 7/1998 Blacket et al.

FOREIGN PATENT DOCUMENTS

| | | |
|---|---|---|
| DE | 2 218 887 | 10/1973 |
| DE | 297 02 834 | 6/1997 |
| DE | 103 59 879 | 8/2004 |

*Primary Examiner*—John C Hong
(74) *Attorney, Agent, or Firm*—Trexler, Bushnell, Giangiorgi, Blackstone & Marr, Ltd

(57) ABSTRACT

A magnetic rivet retention system for a rivet gun, wherein a magnet is provided in a frame that is engageable with a powered handle. The magnet attracts a rivet and aligns the rivet relative to a punch and die of the rivet gun. The magnet is disposed in an internal chamber in a front bushing. The front bushing is threadably engaged with a back bushing, and both are disposed in a chamber which is provided in a C-frame. A compression spring is also disposed in the C-frame, thereby providing that the rivet gun is spring return.

11 Claims, 5 Drawing Sheets

MAGNETIC RIVET RETENTION SYSTEM FOR A RIVET GUN

RELATED APPLICATION (PRIORITY CLAIM)

This application claims the benefit of U.S. Provisional Application Ser. No. 60/652,593, filed Feb. 14, 2005.

BACKGROUND

The present invention generally relates to rivet guns, and specifically relates to rivet retention systems for use with rivet guns.

Rivet guns, such as hydraulic rivet guns, have a head portion which engages a powered body portion. In the case of a hydraulic rivet gun, a C-frame assembly 10 such as is shown in FIG. 1 may engage a hydraulic-powered handle (not specifically shown in FIG. 1). The C-frame assembly 10 includes a C-frame body portion 12 which engages the handle, and is secured to the handle using screws 14.

A threaded bolt 16 is provided, and the threaded bolt 16 includes a head portion 18 and a threaded shaft portion 20. The threaded shaft portion 20 extends through a throughbore 22 which is provided in a back bushing 24 and threadably engages in a front bushing 26. The back bushing 24 and front bushing 26 are disposed in a chamber 28 which is provided in the C-frame 12. A compression spring 30 is also disposed in the chamber 28, generally between the body portion 12 and the handle (not specifically shown in FIG. 1). As such, the rivet gun is hydraulically powered (viz-a-viz the handle) and is spring return (viz-a-viz spring 30).

The C-frame 10 includes spacing 32 for receiving a workpiece. Proximate the spacing 32 is an opening 34 which is in communication with the chamber 28 in which the front bushing 26 is disposed. An end 36 of the front bushing 26 includes a bore 38 for receiving a back end of a punch (not specifically shown in FIG. 1). Specifically, the back end of the punch extends into the opening 34 in the C-frame 12 and extends into the bore 38 in the end 36 of the front bushing 26. A set screw 40 secures the back end of the punch and holds the punch in place relative to the front bushing 26. Proximate the spacing 32 in the C-frame 12 is another opening (not visible in FIG. 1) for receiving an end of a die (not specifically shown in FIG. 1). A set screw 42 is provided to secure the end of the die and hold the die in place relative to the C-frame 12.

In use, a self-piercing rivet is placed inside the punch, and a workpiece is positioned in the spacing 32 provided in the C-frame 12. Then, the handle of the rivet gun is actuated, causing the punch to move toward the die, causing the rivet to set in the workpiece. After the rivet sets, the punch returns to its starting position via the spring force exerted by spring 30.

A problem which exists with regard to rivet guns, such as a hydraulic rivet gun which uses a C-frame as shown in FIG. 1, is the positioning of the rivet in the punch before the gun is actuated. If the rivet is not properly aligned before the rivet gun is actuated, the rivet may not set right during actuation of the rivet gun. To assist in the aligning of rivets, a retaining member (not specifically shown in FIG. 1), such as a urethane ring, may be provided on an end of the punch. However, such retaining members (especially their inside diameters) tend to get worn, thereby losing their effectiveness for precisely positioning rivets.

Furthermore, some rivet guns, such as those rivet guns which us a set of jaws to hold a rivet for broaching, are not practical for some applications. For example, some applications, such as roofing applications, provide that a workpiece is multiple-layered, having glue disposed between at least two of the layers. During riveting, glue may squirt onto the rivet gun, thereby diminishing the effectiveness of the gun during subsequent operation.

OBJECTS AND SUMMARY

An object of an embodiment of the present invention is provide an improved rivet retention system for a rivet gun.

Another object of an embodiment of the present invention is provide a magnetic rivet retention system for a rivet gun.

Yet another object of an embodiment of the present invention is provide a rivet retention system for a rivet gun, where the effectiveness of the system does not substantially diminish as a result of wear of a retaining member in a punch.

Still yet another object of an embodiment of the present invention is provide a rivet retention system for a rivet gun, where the effectiveness of the system does not substantially diminish as a result of glue contacting the rivet gun.

Briefly, and in accordance with at least one of the foregoing objects, an embodiment of the present invention provides a magnetic rivet retention system for a rivet gun, wherein a magnet is provided in a frame that is engageable with a powered handle. The magnet attracts a rivet and aligns the rivet relative to a punch and die of the rivet gun.

In a specific embodiment, the magnet is a rare earth magnet which is disposed in an internal chamber in a front bushing. The front bushing is threadably engaged with a back bushing, and both are disposed in a chamber which is provided in a C-frame body portion. A compression spring is also disposed in the chamber, generally between the body portion and a handle, such as a hydraulically-powered handle. As such, the rivet gun is hydraulically powered (viz-a-viz the handle) and is spring return (viz-a-viz the spring). The C-frame includes spacing for receiving a workpiece. Proximate the spacing is an opening which is in communication with the chamber in which the front and back bushings are disposed. The back end of a punch extends into the opening in the C-frame and is secured in the bore in the end of the front bushing. Preferably, a set screw secures and holds the punch in place relative to the front bushing. Proximate the spacing in the C-frame is another opening for receiving an end of a die. Preferably, a set screw is provided to secure the end of the die and hold the die in place relative to the C-frame.

The magnet which is disposed in the front bushing is configured to attract a rivet and assist in the alignment of the rivet relative to the punch and the die, before actuation of the rivet gun. To further assist with alignment of the rivet, a retaining member, such as a urethane ring, may be disposed on an end of the punch. In use, a rivet is placed in the retaining member, and the magnet inside the front bushing attracts and aligns the rivet. Thereafter, a workpiece is positioned in the spacing provided in the C-frame, and the rivet gun is actuated, causing the punch to move toward the die, causing the rivet to set in the workpiece. After the rivet sets, the punch returns to its starting position via a spring force (provided by the spring that is disposed in chamber in the C-frame).

BRIEF DESCRIPTION OF THE DRAWINGS

The organization and manner of the structure and operation of the invention, together with further objects and advantages thereof, may best be understood by reference to the following description, taken in connection with the accompanying drawings, wherein like reference numerals identify like elements in which.

DESCRIPTION

Figure 1:
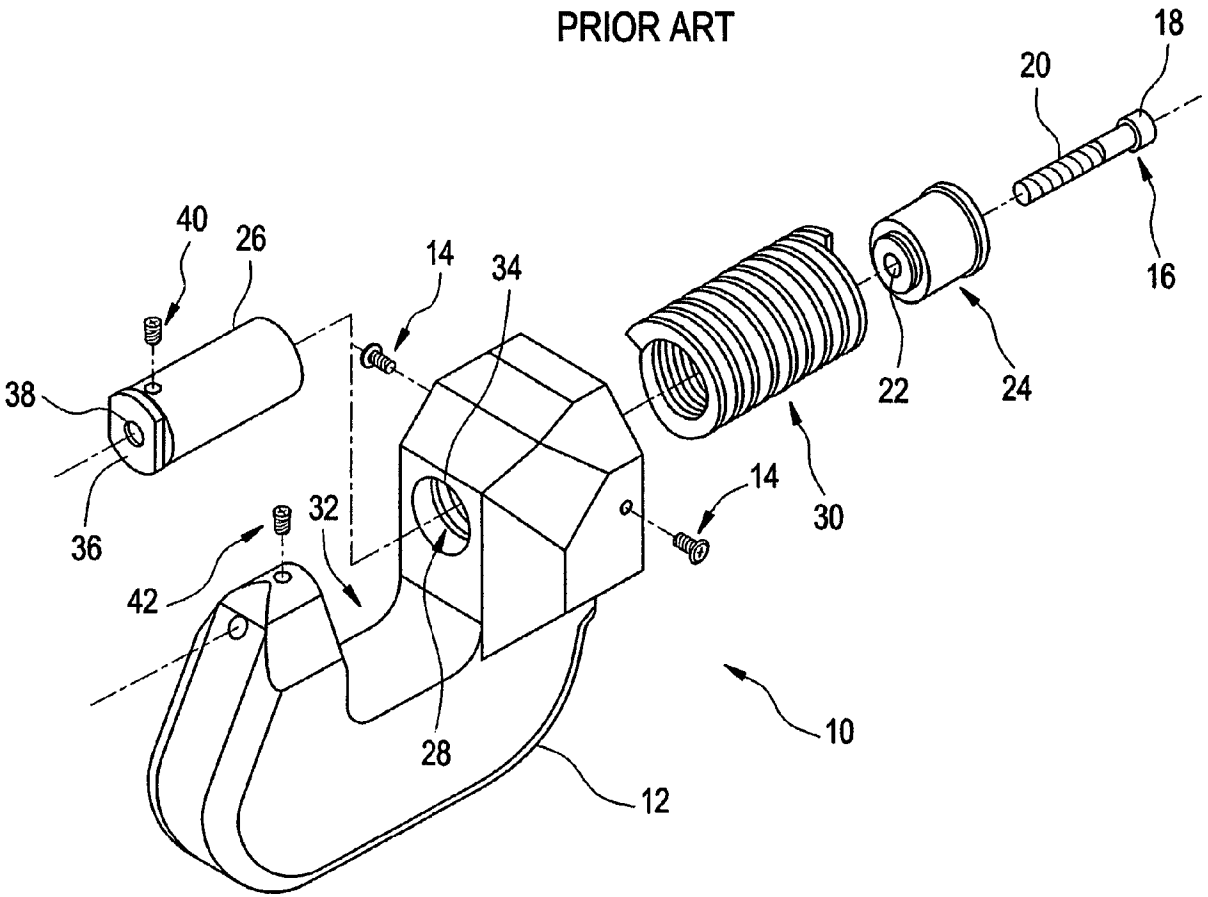
FIG. 1 PRIOR ART
FIG. 1 is an exploded perspective view of an existing C-frame assembly for a rivet gun.

While the present invention may be susceptible to embodiment in different forms, there is shown in the drawings, and herein will be described in detail, an embodiment thereof with the understanding that the present description is to be considered an exemplification of the principles of the invention and is not intended to limit the invention to that as illustrated and described herein.

An embodiment of the present invention provides a magnetic rivet retention system for a rivet gun, wherein a magnet is provided in a frame that is engageable with a powered handle. The magnet attracts a rivet and works to properly align the rivet relative to the rivet gun.

An embodiment of the present invention generally includes all of the components shown in FIG. 1, but does not include the threaded screw 16 and includes an internal magnet, which is not provided in the assembly shown in FIG. 1.

Figure 2:
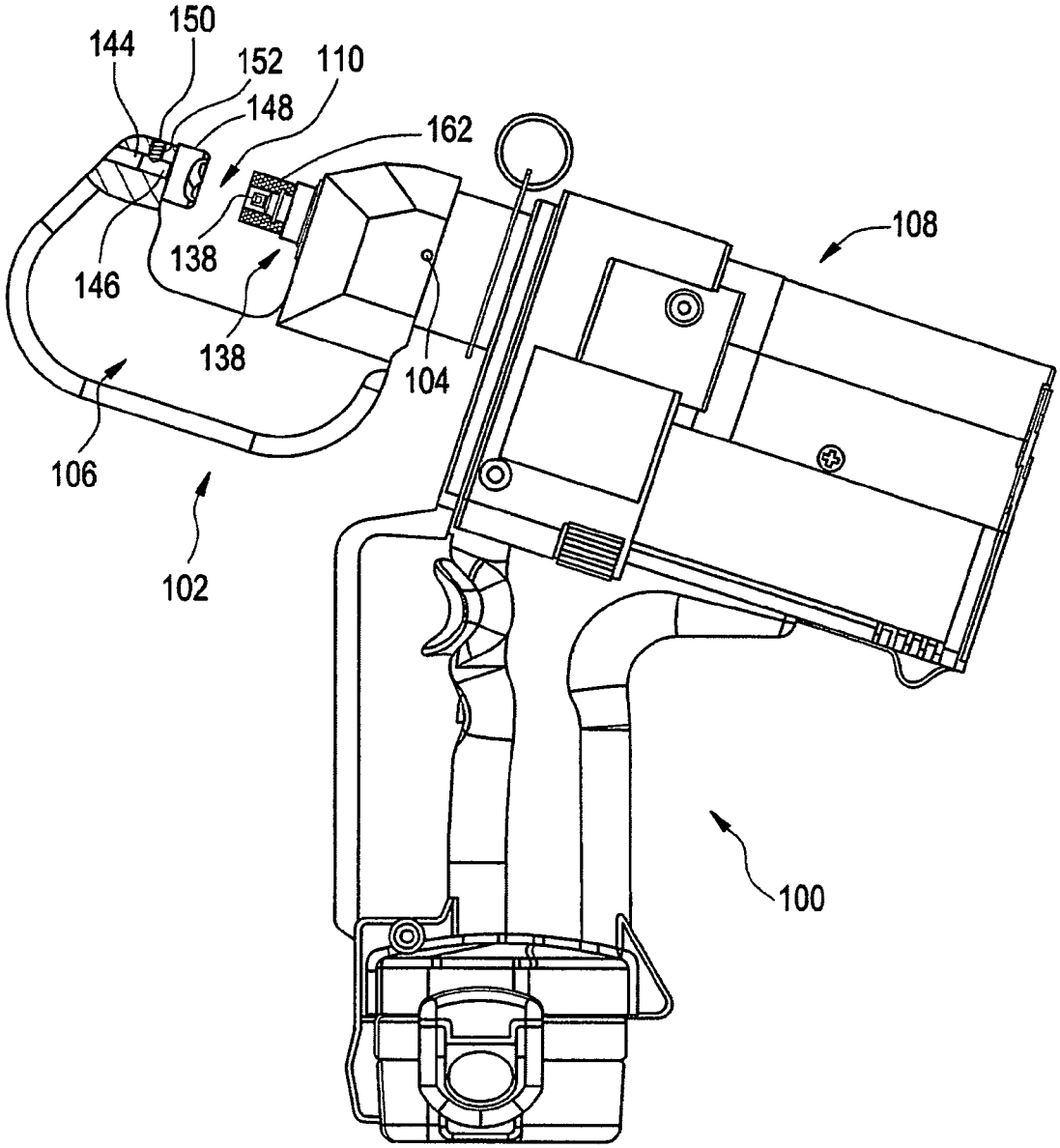
FIG. 2 is a side view of a rivet gun which includes a magnetic rivet retention system which is in accordance with an embodiment of the present invention.
Figure 3:
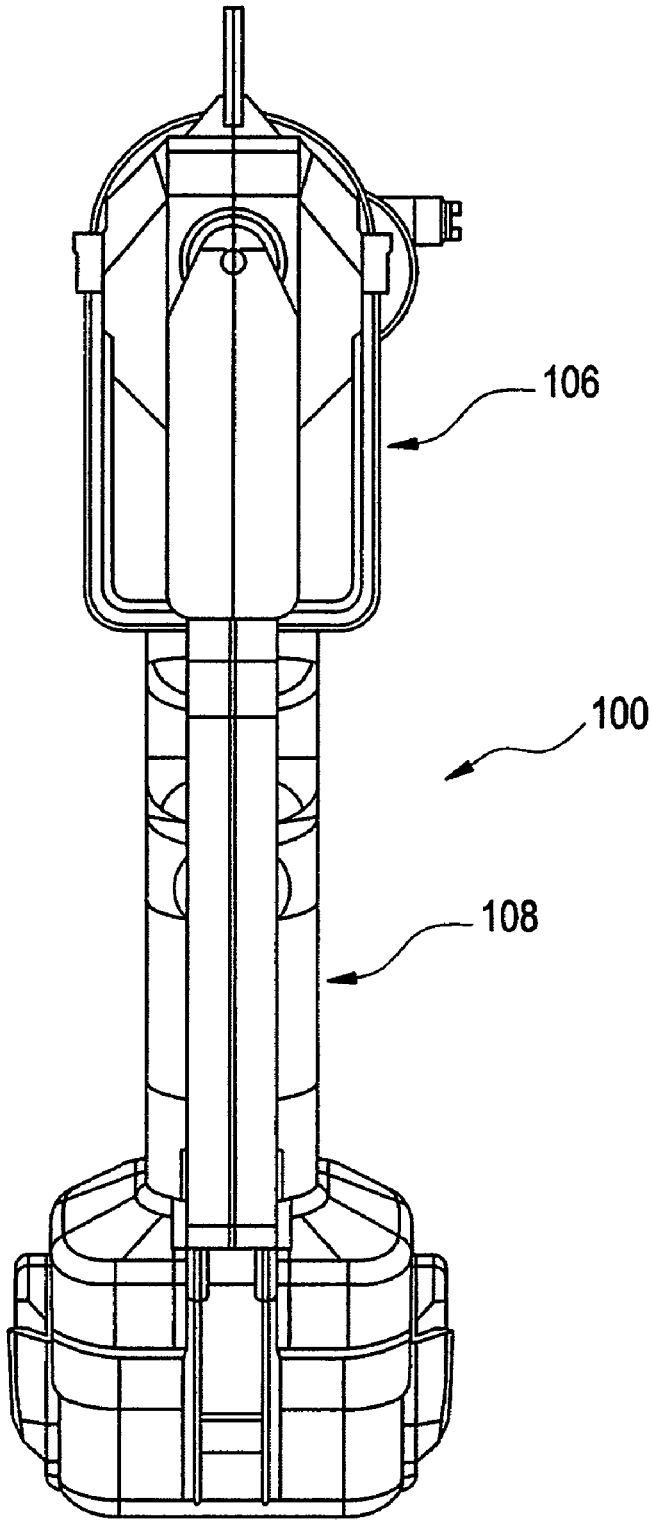
FIG. 3 is an end view of the rivet gun shown in FIG. 2.
Figure 4:
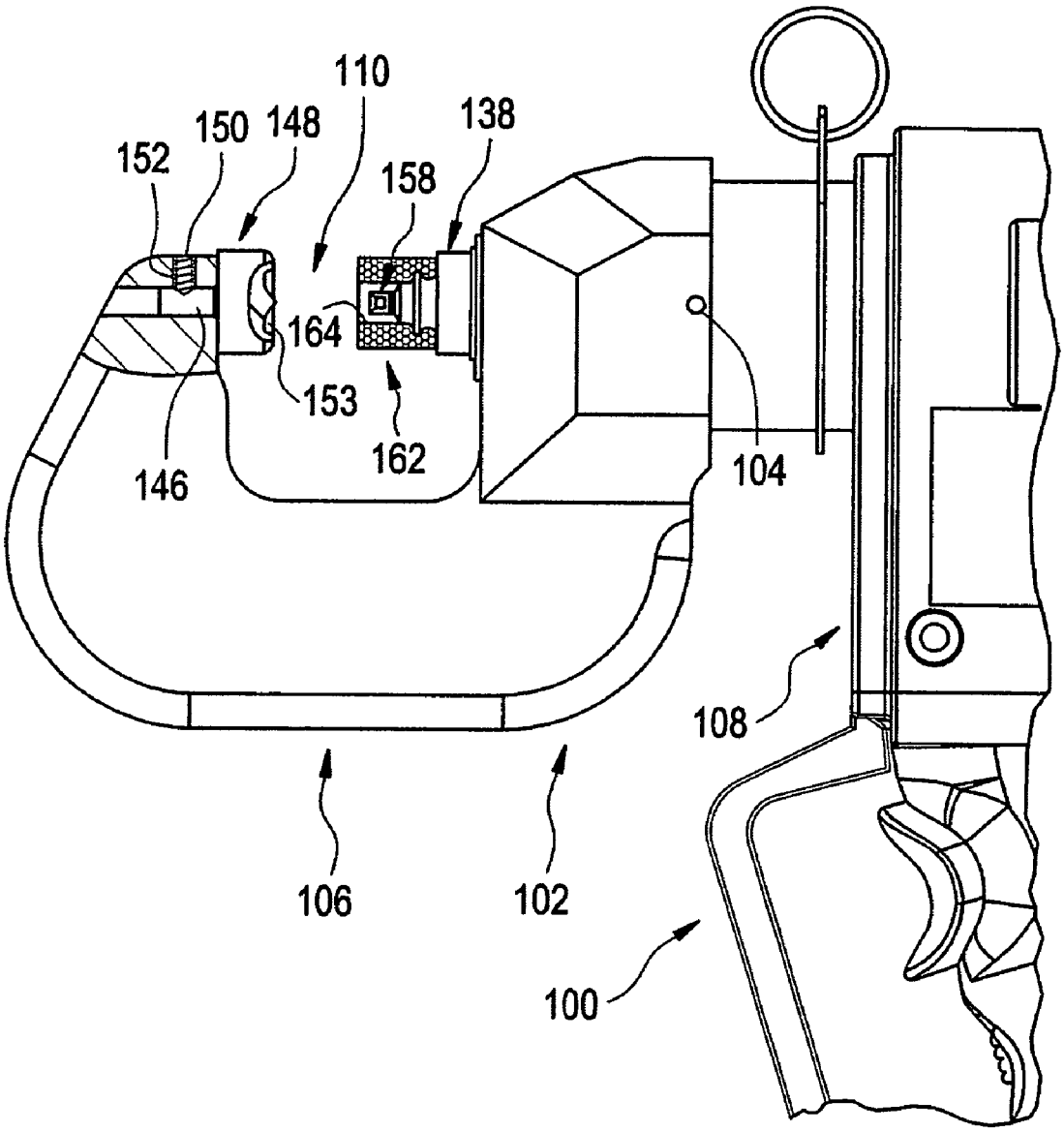
FIG. 4 is a side view of a C-frame portion of the rivet gun shown in FIGS. 2 and 3.

Specifically, FIGS. 2-4 illustrate a rivet gun 100 which includes a C-frame assembly 102 that has a magnetic rivet retention system that is in accordance with an embodiment of the present invention. Like the C-frame assembly 10 shown in FIG. 1, the C-frame assembly 102 shown in FIGS. 2-4 (see specifically FIGS. 2 and 4) includes set screws 104 for securing a C-frame body 106 to a powered handle 108, such as a hydraulically-powered handle.

As shown in FIGS. 2 and 4, the C-frame 106 includes spacing 110 for receiving a workpiece (not shown). Proximate the spacing 110 is an opening 112 (like as is shown in FIG. 1) which is in communication with an internal chamber 114 in the C-frame 106 (see FIG. 5). A front bushing 116 and a back bushing 118 are disposed in the chamber 114 in the C-frame 106. Specifically, the front bushing 116 includes an internally threaded end 120 which receives a corresponding externally threaded end 122 which is provided on the back bushing 118. Preferably, the back bushing 118 is threaded into the front bushing 116 such that a shoulder 124 on the back bushing 118 abuts an end 126 of the front bushing 116. An opposite end 128 of the back bushing 118 provides a recess 129, such as a hex-shaped recess for engagement with a corresponding hex tool (not shown) for threading the back bushing 118 onto the front bushing 116. The back bushing 118 may be formed of stainless steel, for example. A compression spring 130 is also disposed in the chamber 114, generally between the C-frame body portion 106 and the handle 108. As such, the rivet gun 100 is hydraulically-powered, but is spring return.

An opposite end 132 of the front bushing 116 includes an opening 134 for receiving an end 136 of a punch 138, such as a steel punch, which extends into the opening 112 in the C-frame 106. A set screw 140 is disposed in a threaded bore 142 in the front bushing 116 proximate the opening 134 in the end 132 of the front bushing 116, and engages the end 136 of the punch 138 such that the punch 138 is secured relative to the front bushing 116. As shown in FIG. 2, proximate the spacing 110 in the C-frame 106 is another opening 144 for receiving a stem portion end 146 of a die 148. Preferably, a set screw 150 is provided in a threaded bore 152 in the C-frame 106, to secure the stem portion end 146 of the die 148 and hold the die 148 in place relative to the C-frame 106. As shown in FIG. 4, the die 148 includes a recess 153 for facilitating installation of the rivet into the workpiece during actuation of the rivet gun 100.

Figure 5:
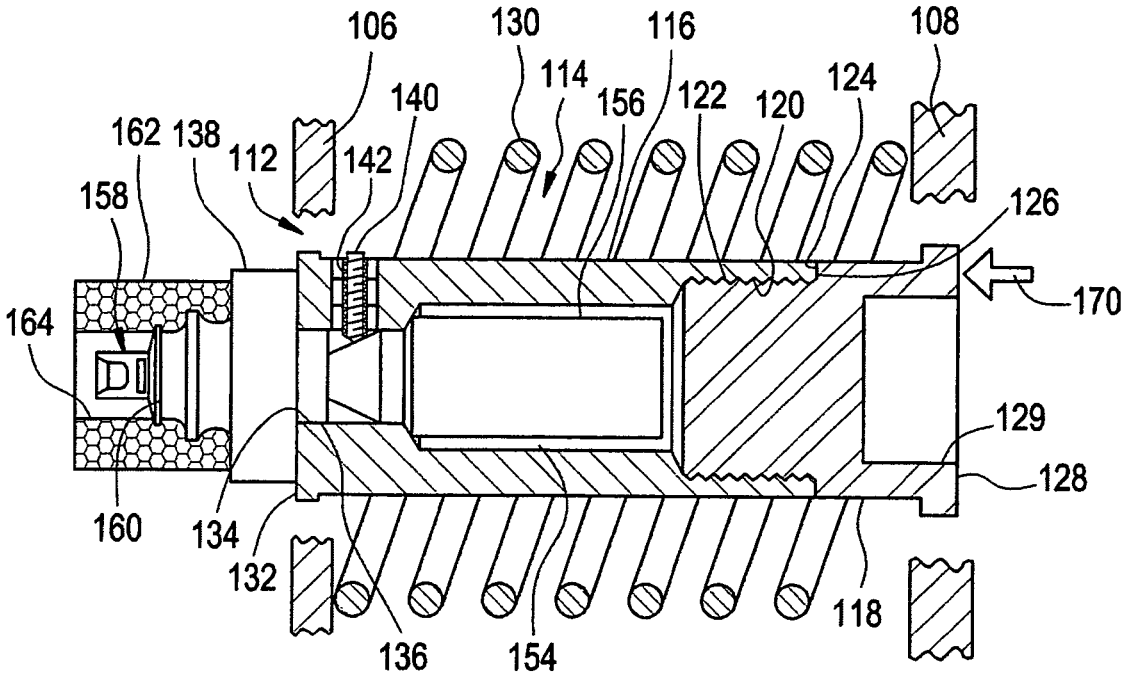
FIG. 5 is a cross-sectional view of the internal components of a C-frame assembly of the rivet gun shown in FIGS. 2 and 3.

As shown in FIG. 5, the front bushing 116 is generally cylindrical, and disposed between the internally threaded end 120 of the front bushing 116 and the opening 134 in the front bushing 116 for receiving the end 136 of the punch 138 is an internal chamber 154. A magnet 156, such a cylindrically-shaped rare earth magnet, is disposed in the chamber 154. Preferably, the magnet 156 is installed in the front bushing 116 from the rear 126 of the bushing 116, wherein the magnet 156 is installed in the end 126 of the front bushing 116 before the back bushing 118 is threaded into the front bushing 116. The magnet 156 may be, for example, a half inch in diameter and three-quarters of an inch long. Regardless, the magnet 156 is configured to attract a rivet 158 relative to a face surface 160 of the punch 138, and assist in the alignment of the rivet 158 relative to the punch 138 (and the die 148 which is generally aligned with the face surface 160 of the punch 138, across the spacing 110 of the C-frame 106), before actuation of the rivet gun 100. To further assist with alignment of the rivet 158, a retaining member 162, such as a urethane ring, may be disposed on the punch 138, such that the face surface 160 of the punch 138 is disposed in an opening 164 in the retaining member 162.

Preferably, the magnet 156 is housed in the chamber 154 provided in the front bushing 116 such that no load is applied to the magnet 156 during operation of the rivet gun 100. Preferably, all forces are transmitted via the back bushing 118 to the front busing 116 via a force (represented by arrow 170 in FIG. 5) applied to the back bushing 118 by the hydraulics of the handle 108 of the rivet gun 100 and via the threaded engagement between the two bushings 116, 118 in the C-frame 106. While the magnet 156 may either be free-floating in the chamber 154 in the front bushing 116 or may be somehow retained relative to the front bushing 116, preferably the magnet 156 is generally isolated from the application of load.

In use, a rivet 158 is placed in the retaining member 162 (if so provided), and the magnet 156 inside the front bushing 116 attracts and aligns the rivet 158 relative to the face surface 160 of the punch 138. Thereafter, a workpiece is positioned in the spacing 110 provided in the C-frame 106, and the rivet gun 100 is actuated, causing the punch 138 to move toward the die 148, causing the rivet 158 to set in the workpiece. After the rivet 158 sets, the punch 138 returns to its starting position via spring force applied by the spring 130 that is disposed in chamber 114 in the C-frame 106.

The present invention provides an improved rivet retention system for a rivet gun in the form of a magnetic retention system. While a retaining member may be provided on the punch of the rivet gun, the effectiveness of the magnetic rivet retaining system does not substantially diminish as a result of wear of the retaining member, such as wear of its inside diameter. Additionally, the effectiveness of the magnetic rivet retaining system does not substantially diminish as a result of, for example, glue contacting the rivet gun, which may be a common occurrence in certain applications.

While an embodiment of the present invention is shown and described, it is envisioned that those skilled in the art may devise various modifications of the present invention without departing from the spirit and scope of the disclosure.

What is claimed is:

1. A rivet gun comprising: a handle which holds a die; a punch; and a bushing having an opening configured to receive the punch and an internal chanter in communication with said opening, wherein the internal chamber contains a magnet which attracts a rivet and aligns the rivet relative to the punch and the die of the rivet gun, wherein the magnet is housed in the bushing either free floating or so retained relative to the bushing that the magnet contacts the punch as well as the bushing but no load is applied to the magnet during operation of the rivet gun.

2. The rivet gun as recited in claim 1, wherein the magnet comprises a rare earth magnet.

3. The rivet gun as recited in claim 2, wherein the magnet is free-floating in the internal chamber of the bushing.

4. The rivet gun as recited in claim 1, further comprising a back bushing threadably engaged with the bushing which has the magnet disposed therein.

5. The rivet gun as recited in claim 1, limber comprising a frame, wherein the bushing is disposed in a chamber in the flume, further comprising a compression spring which is also disposed in the chamber, generally between a body portion of the frame and a portion of the handle to which the frame is engageable.

6. The magnetic rivet retention system an recited in claim 1, further comprising a set screw, wherein the set screw secures the punch in the place relative to the bushing.

7. The rivet gun as recited in claim 1, further comprising a retaining member, wherein the retaining member is disposed on an end of the punch, and is configured to retain the rivet.

8. The rivet gun as recited in claim 7, wherein the retaining member comprises a urethane ring.

9. The rivet gun as recited in claim 4, wherein an end of the back bushing provides a recess configured for engagement with a corresponding tool for threading the back bushing onto the bushing.

10. The rivet gun as recited in claim 5, further comprising a back bushing threadably engaged with the bushing which has the magnet disposed therein, wherein the frame includes spacing for receiving a workpiece, and proximate the spacing is an opening which is in communication with the chamber in which the bushing and back bushing are disposed.

11. The rivet gun as recited in claim 1, wherein a bore is provided in an end of the bushing, wherein a back end of the punch extends into and is secured in the bore in the end of the bushing.

* * * * *